United States Patent [19]

Stahl

[11] Patent Number: 4,930,987

[45] Date of Patent: Jun. 5, 1990

[54] MARINE PROPELLER AND HUB ASSEMBLY OF PLASTIC

[76] Inventor: Brad Stahl, 778-B Peach St., San Luis Obispo, Calif. 93401

[21] Appl. No.: 356,181

[22] Filed: May 24, 1989

[51] Int. Cl.[5] ..... F01D 5/30

[52] U.S. Cl. ..... 416/93 A; 416/219 A; 416/244 B

[58] Field of Search ..... 416/214 R, 134 R, 93 A, 416/93 M, 219 A, 220 A, 241 A, 244 B, 245 A

[56] References Cited

U.S. PATENT DOCUMENTS

| | | | |
|---|---|---|---|
| 123,274 | 1/1872 | McCay | 416/244 B X |
| 335,640 | 2/1886 | Simmons | 416/220 A X |
| 390,615 | 10/1888 | Nye | 416/220 A |
| 548,655 | 10/1895 | Pagan | 416/93 A |
| 3,246,699 | 4/1966 | Jocz | 416/244 B X |
| 3,764,228 | 10/1973 | Shook | 416/93 A |
| 3,876,331 | 4/1975 | DenHerder et al. | 416/93 A |
| 4,417,852 | 11/1983 | Costabile et al. | 416/93 A X |

FOREIGN PATENT DOCUMENTS

| | | | |
|---|---|---|---|
| 98137 | 6/1958 | Norway | 416/214 R |
| 2201198 | 8/1988 | United Kingdom | 416/214 R |

*Primary Examiner*—Robert E. Garrett
*Assistant Examiner*—John T. Kwon
*Attorney, Agent, or Firm*—Townsend and Townsend

[57] ABSTRACT

Each blade includes at its root a root portion that slides axially into a re-entrant cavity that extends axially in the hub. End caps prevent axial removal of the blade roots from the hub. Thus, it is possible to replace an individual damaged blade, and the hubs are interchangeable from ship to ship, although the blades may vary slightly. All of the parts are injection molded of a high-strength fiber-reinforced plastic. The entire assembly can be produced at approximately half the cost of conventional metal propellers. The propeller is intended for use with engines developing 90–250 HP, and the diameter of the propeller is 16–18 inches. The various parts includes apertures and passages so as not to interfere with the discharge of exhaust gases.

8 Claims, 2 Drawing Sheets

MARINE PROPELLER AND HUB ASSEMBLY OF PLASTIC

BACKGROUND OF THE INVENTION

1. Field of the Invention

The present invention is in the field of marine propellers, and specifically relates to a hub and propeller assembly made entirely of plastic.

2. The Prior Art

Since the advent of powered ships, marine propellers have traditionally been cast or forged of metal and the hub and blades were formed as a single unitary part. This traditional approach provided strength in the absence of alternative materials, and confidence that the blades would not come loose from the hub.

However, this traditional approach had its inherent disadvantages. The desired strength of the metal blades gave rise to the possibility that if the blade struck a foreign object, enormous forces could be transmitted through the metal blade and hub to the drive shaft, possibly bending it or damaging its mounting.

Because the blades and hub formed a single piece, damage to even one blade required replacement of the entire unit.

Also, if a different pitch were desired, it could only be provided by replacing the entire unit.

As progress in plastic technology developed rapidly after World War II, more than one inventor became interested in the possibility of molding propellers of plastic. The least demanding application appeared to be in electric fans. Typical of these efforts are U.S. Pat. No. 2,811,303 to Ault, et al. and U.S. Pat. No. 4,063,852 to O'Connor. These patents describe molded plastic impellers, and in each case, the blades and hub formed a unitary structure.

As early as 1950, Thompson, J. R. Jr. in U.S. Pat. No. 2,498,348 described a marine propeller of metal-reinforced rubber, which was supposed to reduce fouling of the propeller in weeds.

With further passage of time, plastic manufacturing techniques became more sophisticated as evidenced by U.S. Pat. No. 4,483,214 of Mayer. Mayer describes the production of a spider for a high-speed flywheel, and specifically discusses the use of carbon fibres or glass fibres in an epoxy resin matrix. Even in the spider he describes, the spokes are inseparable from the hub.

In U.S. Pat. No. 4,589,176, Rosman, et al. describe a fiber-composite turbine blade and a method for its construction. The structure of the hub and the manner in which the blade is attached to the hub are not described.

The prior art does not appear to include a practical marine propeller like the present invention.

SUMMARY OF THE INVENTION

The propeller and hub assembly of the present invention provides a low-cost alternative to aluminum and stainless steel propellers. The propeller and hub assembly of the present invention can be manufactured for approximately half of the cost of manufacturing the metal propellers.

In accordance with the present invention, the propeller blades and the hub assembly are separate parts. The blades are molded integrally with a root portion and are locked into the hub portion when the parts are assembled. The fore and aft ends of the hub bear against first and second end caps, respectively. The first end cap provides a durable contact with the threaded portion of an engine driveshaft. All of the parts are injection molded by a high-strength plastic injection molding technique. The technique is applicable to assemblies having two to six propeller blades.

In accordance with the present invention, the blades of the propeller are individually replaceable in the event one of them is damaged. Alternatively, all of the blades can be replaced at once with blades of greater or less pitch to change the hydrodynamic characteristics of the propeller. In this case, it is not necessary to replace the hub.

In accordance with the present invention, the blades are designed to shear and break away to prevent damage to the driveshaft. Compared with metal blades, the blades in accordance with the present invention are lighter and more flexible which results in less noise and vibration.

Although different makes of ships may require slightly different blades, the same hubs can be used for different makes of ships.

In the preferred embodiment, each blade and root portion is retained within the hub by interlocking shoulders, one formed on the blade and root portion and one formed on the hub. This ensures a simple, secure locking mechanism which can be easily disassembled when desired.

The present invention includes passages formed in the blade and root portion of the propeller. Passages formed in the end caps are aligned with the blade and root portion passages. The exhaust exits the propeller through the first end cap passages, the blade and root portion passages and the second end cap passages, thereby improving efficiency and performance of the engine.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
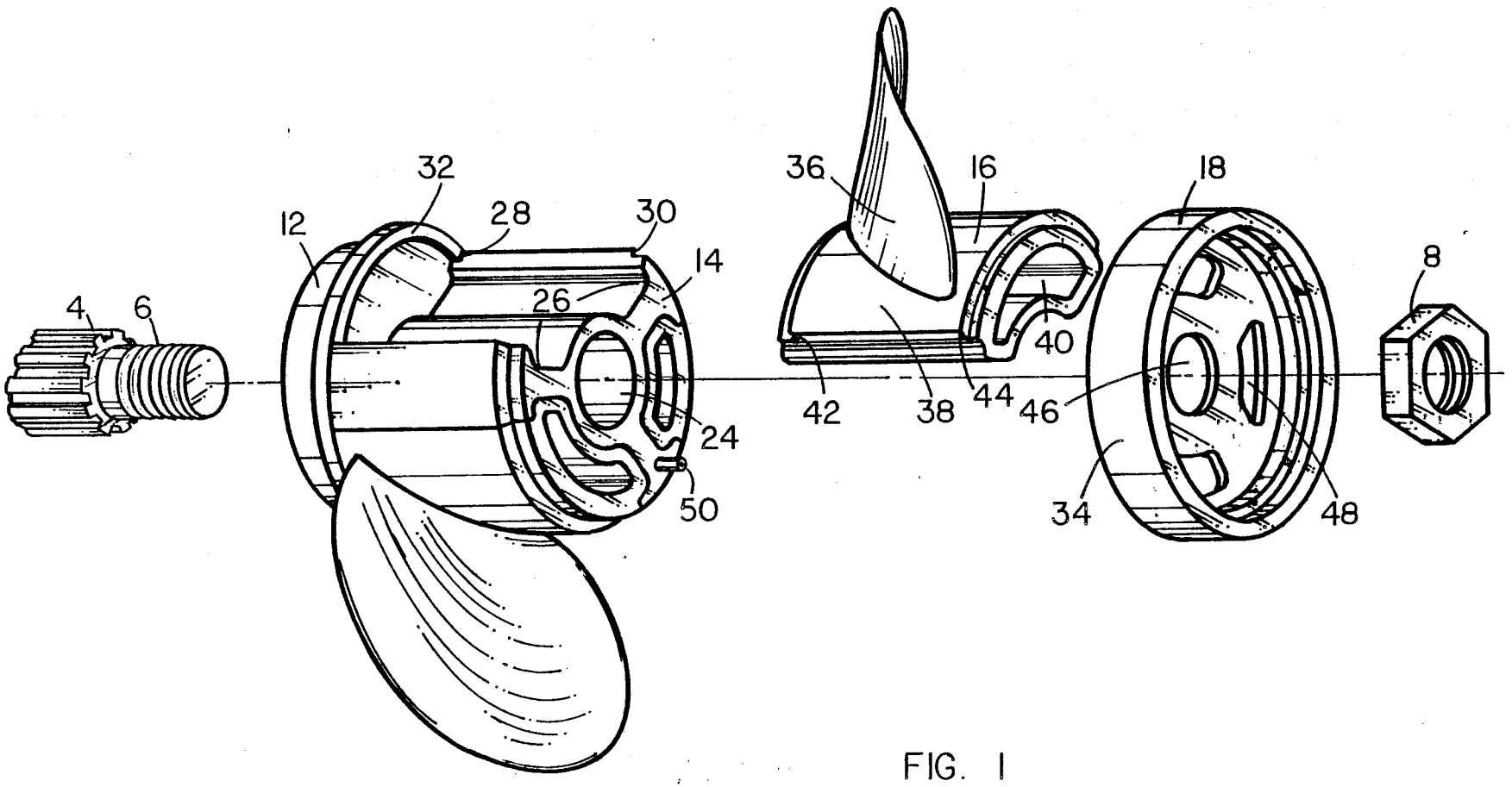
FIG. 1 is an exploded perspective view of the propeller and hub assembly in accordance with a preferred embodiment of the present invention.
Figure 2:
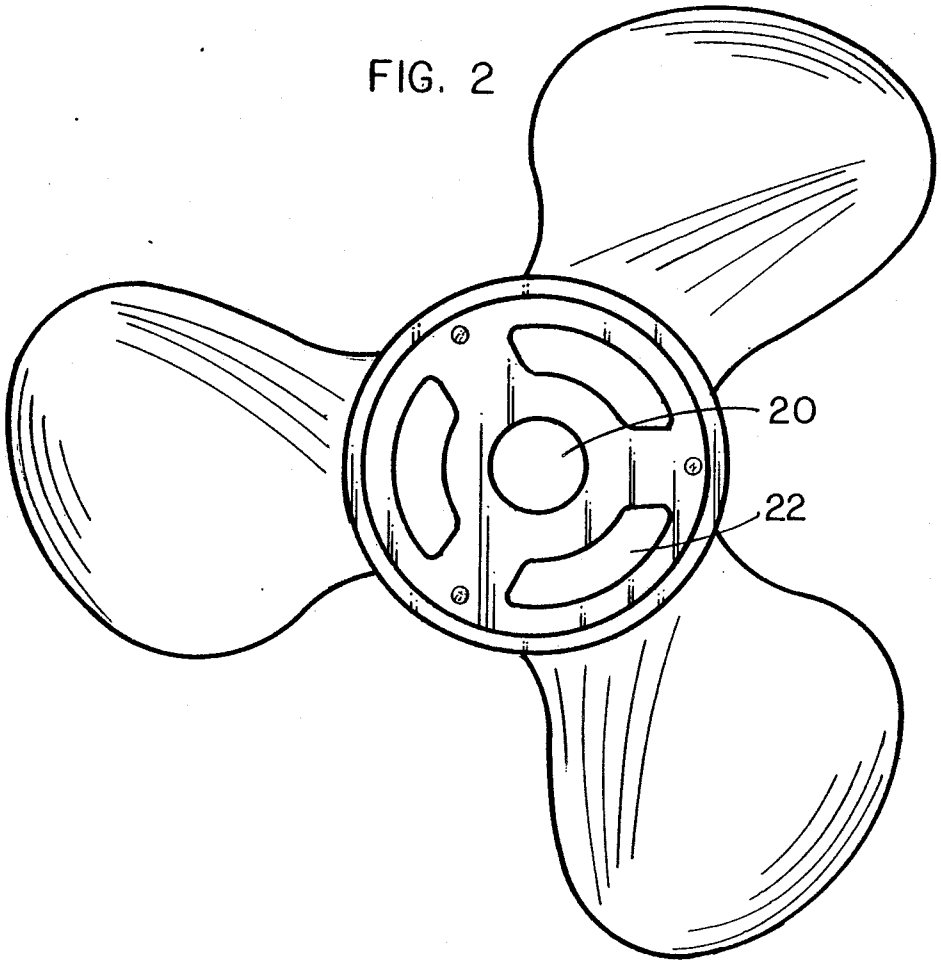
FIG. 2 is a front elevational view of the propeller and hub assembly of FIG. 1; and, FIG. 3 is a side elevational view of the invention shown in FIGS. 1 and 2.
Figure 3:
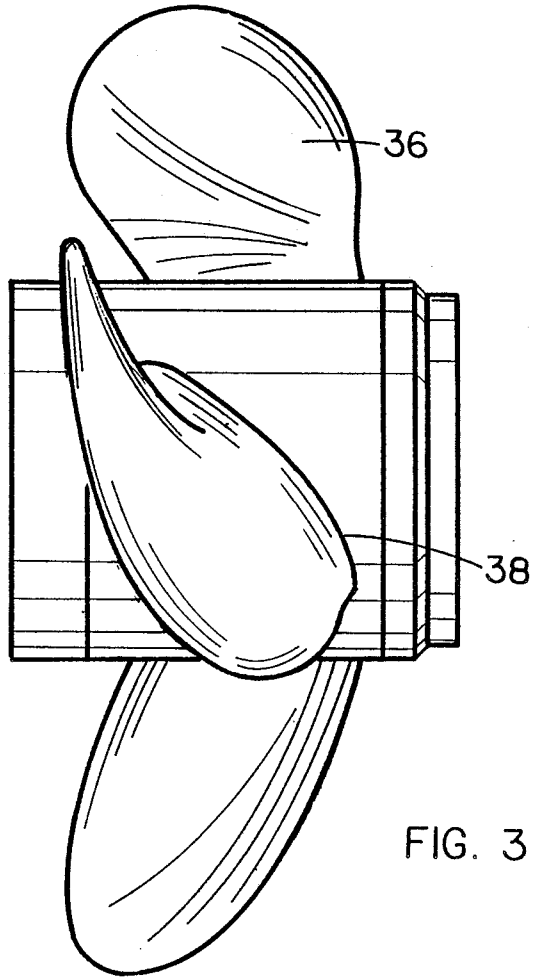

Referring now to the drawings, FIGS. 1–3 illustrate the propeller and hub assembly of the present invention. In a typical application, the diameter of the propeller is 16 to 18 inches, and it is intended for use with engines that develop 90 to 250 horsepower.

In the preferred embodiment, all of the parts of the present invention are injection molded of a plastic known in the industry as VERTON containing 30 percent of long fiber (0.50 inch) reinforcement filler. VER- TON is a registered trademark of Imperial Chemical Industries.

With reference to FIG. 1, and by way of a brief overview, the propeller and hub assembly includes a first end cap 12, a hub 14, three unitary blade and root portions, of which the piece 16 is typical, and a second end cap 18.

The root portions are pushed axially into the hub 14, the end caps 12 and 18 are then fitted onto the hub 14, and the assembly is pushed axially onto the splined driveshaft 4 until the threaded portion 6 extends beyond the second end cap, so that the assembly can be retained on the driveshaft by the nut 8. The various parts of the assembly will now be described in greater detail.

The first end cap 12 includes a central bore 20 and three apertures, of which the aperture 22 is typical. These are best seen in FIG. 2. The central bore 20 accepts the splined driveshaft 4. The apertures are to permit exhausted gases to pass through the hub.

The hub 14 includes a central bore 24 and three elongated re-entrant or undercut cavities, of which the cavity 26 is typical. The fore and aft ends of the hub 14 include shoulders 28, 30 respectively against which the rims 32, 34 of the first end cap and second end cap bear.

In a preferred embodiment, a splined metal insert is molded or pressed into the hub at the fore end of the central bore 24 to provide a more durable contact with the splined driveshaft 4.

In a second preferred embodiment, the first end cap 12 and the hub 14 are molded as a unitary part, but are otherwise the same as described above.

The blade and root part 16 includes a blade portion 36 and a root portion 38. The root portion 38 includes an axially extending passage 40 through which exhaust gases pass. The root portion 38 includes shoulders 42, 44 that are spaced the same distance as the shoulders 28, 30, so that when the root portion is inserted into the hub 14, a continuous shoulder extends all around the edges of the assembly.

The second end cap 18 includes a central hole 46 that clears the threads of the threaded portion 6 of the splined driveshaft 4. The second end cap also includes apertures, of which the aperture 48 is typical, for the exhaust gas to pass through. The various exhaust gas passages are kept in alignment by pins that extend fore and aft of the hub 14, locking it to the first and second end caps 12, 18. The pin 50 is typical of these pins.

The cavity 26 and the root portion 38 are both slightly tapered being slightly smaller at their fore ends than at their rear ends. This has two benefits. It facilitates release of the parts from the mold in which they are cast, and it prevents inserting the root 38 in the wrong direction, i.e., back aftward as viewed in FIG. 1.

To remove the entire assembly, one need only loosen the nut 8 and draw the assembly from the splined driveshaft 4.

If only one blade is to be replaced, the second end cap 18 is removed from the assembly, and the damaged blade is drawn out of the hub and replaced by a new blade and blade root, all of the parts are composed of a high-strength fiber-reinforced plastic, which gives the necessary strength and toughness to the parts.

Thus, there has been described a marine propeller and hub assembly that provides a low-cost alternative to conventional propellers of aluminum or stainless steel. The blades can be replaced individually or together, so that the repair of a damaged propeller requires only replacement of the damaged blades rather than the entire assembly. Although the dimensions of the blades may vary from ship to ship, a common hub can be used for various ships.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. A marine propeller and hub assembly comprising:

a hub portion including a plurality of extensions extending axially outwardly from a central section, said central section including a central bore formed therein, said hub portion including a plurality of re-entrant cavities surrounding said central portion and formed between adjacent extensions;

a unitary blade and root portion configured to be slidably axially inserted into each of said re-entrant cavities, an axially extending exhaust passage formed in said root portion; and means for radially retaining said unitary blade and root portion within said re-entrant cavity.

2. The marine propeller and hub assembly as defined by claim 1 wherein said means for radially retaining said unitary blade and root portion within said re-entrant cavity comprises cooperating shoulders formed on said hub portion and said root portion.

3. The marine propeller and hub assembly as defined by claim 2 wherein said cooperating shoulders are formed on a radial outermost portion of the respective hub portion and root portion.

4. The marine propeller and hub assembly as defined by claim 1 wherein said hub portion and said unitary blade and root portion are constructed of a high strength fiber-reinforced plastic.

5. The marine propeller and hub assembly as defined by claim 1 further comprising a first end cap disposed at one end of said hub portion partially overlying said re-entrant cavities for preventing axial removal of said unitary blade and root portion from said hub, said first end cap including apertures maintained in alignment with said exhaust passages.

6. The marine propeller and hub assembly as defined by claim 5 further comprising a second end cap disposed at the end of said hub portion opposite said first end cap partially overlying said re-entrant cavities for preventing axial removal of said unitary blade and root portion from said hub, said second end cap including apertures maintained in alignment with said exhaust passages.

7. A marine propeller and hub assembly comprising:

a hub portion including a plurality of extensions extending axially outwardly from a central section, said central section including a central bore formed therein, said hub portion including a plurality of re-entrant cavities surrounding said central portion and formed between adjacent extensions;

a unitary blade and root portion configured to be slidably axially inserted into each of said re-entrant cavities, an axially extending exhaust passage formed in said root portion;

cooperating shoulders formed on said hub portion and said root portion for radially retaining said unitary blade and root portion within said re-entrant cavity, said cooperating shoulders formed on a radial outermost portion of the respective hub portion and root portion;

a first end cap disposed at one end of said hub portion partially overlying said re-entrant cavities for preventing axial removal of said unitary blade and root portion from said hub, said first end cap including apertures maintained in alignment with said exhaust passages; and a second end cap disposed at the end of said hub portion opposite said first end cap partially overlying said re-entrant cavities for preventing axial removal of said unitary blade and root portion from said hub, said second end cap including apertures maintained in alignment with said exhaust passages.

8. The marine propeller and hub assembly as defined by claim 7 wherein said hub portion and said unitary blade and root portion are constructed of a high strength fiber-reinforced plastic.

* * * * *